US005605484A

United States Patent [19]

Bailey et al.

[11] Patent Number: 5,605,484

[45] Date of Patent: *Feb. 25, 1997

[54] CRT ELECTRON GUN CLEANING USING CARBON DIOXIDE SNOW

[75] Inventors: Richard A. Bailey, Canton, Mich.; John C. Midavaine, Rochester, N.Y.

[73] Assignee: Philips Electronics North America Corporation, New York, N.Y.

[ * ] Notice: The term of this patent shall not extend beyond the expiration date of Pat. No. 5,462,468.

[21] Appl. No.: 525,434

[22] Filed: Sep. 7, 1995

Related U.S. Application Data

[63] Continuation of Ser. No. 358,450, Dec. 16, 1994, Pat. No. 5,462,468.

[51] Int. Cl.[6] ..... H01J 9/38

[52] U.S. Cl. ..... 445/59; 445/60

[58] Field of Search ..... 445/59, 70, 73, 445/60

[56] References Cited

U.S. PATENT DOCUMENTS

| | | | |
|---|---|---|---|
| 3,712,699 | 1/1973 | Syster | 445/59 |
| 5,135,420 | 8/1992 | Sumi et al. | 445/59 |
| 5,244,428 | 9/1993 | Welsch et al. | 445/59 |
| 5,312,280 | 5/1994 | Kloba et al. | 445/59 |
| 5,462,468 | 10/1995 | Bailey et al. | 445/59 |

*Primary Examiner*—P. Austin Bradley
*Assistant Examiner*—Jeffrey T. Knapp
*Attorney, Agent, or Firm*—John C. Fox

[57] ABSTRACT

A cleaning system and technique for CRT electron guns is provided in which $CO_2$ snow is utilized to clean contaminants from the electron gun. The $CO_2$ snow and $CO_2$ gas are directed onto the electron gun through small orifices in nozzles arranged at angular positions relative to one another and relative to the electron gun. This enables complete cleaning of the electron gun upon the rotation and movement of the electron gun relative to the two nozzles.

8 Claims, 2 Drawing Sheets

CRT ELECTRON GUN CLEANING USING CARBON DIOXIDE SNOW

This application is a continuation of parent application, Ser. No. 08/358,450, filed Dec. 16, 1994, now U.S. Pat. No. 5,462,468, and all benefits of such earlier application are hereby claimed for this continuation.

The present invention is directed to an apparatus and technique for cleaning CRT electron guns during assembly of CRT display arrangements. In particular, the present invention is directed to cleaning such CRT guns by use of a jet spray of $CO_2$ dry ice particles or "snow" and $CO_2$ gas.

BACKGROUND OF THE INVENTION

In assembling CRT display devices, or any display devices utilizing electron guns, an important aspect is to provide the electron guns into the display device in an ultra clean condition. Particles that adhere to such electron guns, as well as oils and greases that appear during construction of the electron gun, must be removed in order to obtain and improve high voltage emission and CRT life performance. The ability to clean the electron guns from such various contaminants is an extremely necessary operation in order to reduce the number of rejects of such electron guns both in constructing display devices and resulting in subsequent customer problems.

Current CRT gun cleaning techniques typically use aqueous processes. This means that CRT guns are immersed in distilled water and agitated, or they are sprayed with distilled water, to remove particulate contamination. Many problems, however, arise when a water cleaning process is used to clean CRT electron guns. For example, aqueous cleaning of blind spots or holes and small crevices is very difficult. Further, aqueous processes require careful engineering and process control. Also, various residues are difficult to rinse from metal and/or synthetic resin surfaces of CRT guns.

The prior use of distilled water rinsing, or even an alcohol rinsing and cleaning technique, has resulted in many difficulties. For example, aqueous cleaning may require a significant amount of floor space in carrying out such cleaning. Further, drying CRT electron guns having complex geometry is difficult to accomplish quickly where crevices and blind holes occur. Moreover, CRT gun compatibility with water is poor since corrosion of metals or stress cracking of certain materials may occur. Finally, high purity water is necessary for CRT gun cleaning. High purity water can be very expensive depending on its purity and the volume used.

SUMMARY OF THE INVENTION

It is an object of the present invention to enable cleaning of CRT electron guns in a labor saving process. In this respect, chronic water washing and drying problems that result in rust and water spots on the gun parts can be eliminated. The process time for carrying out cleaning of CRT guns can be shortened, while the throughput of such clean CRT guns is increased.

The CRT gun cleaning arrangement and technique of the present invention minimizes handling problems occurring in the prior art and reduces recontamination of CRT gun products after initial cleaning. Mechanical changes to the CRT electron gun can also be prevented during cleaning according to the present invention.

The CRT gun cleaning according to the present invention is carried out by using a carbon dioxide snow. Thus, cleaning by a cryo-jet spray of $CO_2$ solid particles and gas has multiple degrees of freedom in both process design and concentration. This enables the $CO_2$ process to provide effective cleaning for complex CRT electron gun geometries.

Also, particulate contamination removal occurs much more effectively according to the present invention. Cleaning by $CO_2$ particles and gas according to the present invention is comparable to solvent cleaning in effectiveness for removing thin hydrocarbon films, and also involves a dry cleaning technique which eliminates rust potential. The $CO_2$ cleaning technique of the present invention is relatively easy to maintain and requires less space because rinsing tanks and drying ovens which are used in the previous aqueous systems are no longer necessary.

The use of $CO_2$ for cleaning CRT electron guns involves few problems with worker safety compared to the use of many solvents that have been previously used. The $CO_2$ technique is not flammable nor explosive. Moreover, $CO_2$ is environmentally friendly.

The present invention is carried out by the process of heating an electron gun structure, rotating the electron gun structure and passing combined $CO_2$ dry ice particles and $CO_2$ gas along all surfaces of the electron gun to remove contaminants from the electron gun.

This process of the present invention is carried out by first mounting the CRT electron gun to be cleaned onto a spindle and carrying out a heating operation. The heating station may incorporate halogen infrared lamps, for example, to heat the CRT gun. The heating is carried out to a temperature greater than 65° C. (150° F) but less than 125° C. (257° F). Such heating is sufficient to prevent condensation from forming on the CRT gun during cleaning.

At the cleaning position of the CRT gun, the gun is rotated to a speed of 300 RPM maximum. A greater speed than 300 RPM may result in mechanical damage to the CRT gun, while slower speeds than 300 RPM will require longer cleaning cycle times.

In the cleaning process, liquid $CO_2$ is supplied to two cleaning nozzles at a pressure of about 835 psi. The nozzles have orifices for converting liquid $CO_2$ to a cryo jet spray of solid dry ice particles or snow of $CO_2$ and $CO_2$ gas. The orifices of the nozzles control the size of the dry ice particles and typically may have an inside diameter of 0,016 to 0,020 inches.

During the cleaning cycle according to the present invention, the cleaning nozzles are moved parallel to the surface of the CRT gun. The cryo jet spray of $CO_2$ particles cleans downward along the body of the gun. A typical cleaning time may be from 2 to 3 seconds. The cryo jet spray of dry ice particles or snow dislodges contaminants from the CRT gun and the removed contaminants are then carried away by the $CO_2$ gaseous stream.

The two cleaning nozzles are directed at the CRT gun at a distance from the gun and both at an angle to the gun and at an angle to each other so that cleaning is maximized. In this respect, the two cleaning nozzles are positioned 90° C. from each other about the axis of the CRT gun so that they oppose each other. This provides a more even pressure against the electron gun being cleaned since the two $CO_2$ cryo jet spray streams effectively oppose each other. The two cleaning nozzles are also positioned at an angle with respect to each other in a direction along the axis of the CRT gun. This helps to maximize the cleaning action.

The $CO_2$ is provided to the nozzles at a pressure of 835 psi. This can be accomplished by way of a pressure boosting system to increase $CO_2$ pressure of 350 psi from the bulk tank to the pressure of operation of 835 psi. The $CO_2$ is processed through a purifier to create high purity $CO_2$ (99.999% pure). This helps the precision cleaning process.

In order to remove the contaminating particles from the mounted and rotating electron gun and away from the cleaning zone, a totally laminar high velocity HEPA (High Efficiency Particle-free Air) filtered air flow of 375 feet per minute is directed to the CRT gun by way of a localized process control system. This isolates any contaminating effects of personnel, processes, equipment and ambient environment from the CRT gun. Such laminar air flow will then carry the potential contaminating particles away from the electron gun and out of the cleaning zone.

In addition, an air ionization system is provided to control build-up of static electricity on the CRT gun. Accordingly, electrostatic attraction of particles to the gun after cleaning is prevented.

A filtered exhaust system is utilized to provide a balanced negative pressure at the downstream side of the gas flow. This ensures gas flow laminarity, exhausts heat from the heating position, exhausts $CO_2$ from the cleaning position and captures particles carried in the air foil.

BRIEF DESCRIPTION OF THE DRAWING FIGURES

The present invention will be described with respect to the accompanying drawing figures which show various schematic arrangements, in which.

DESCRIPTION OF THE INVENTION

Figure 4:
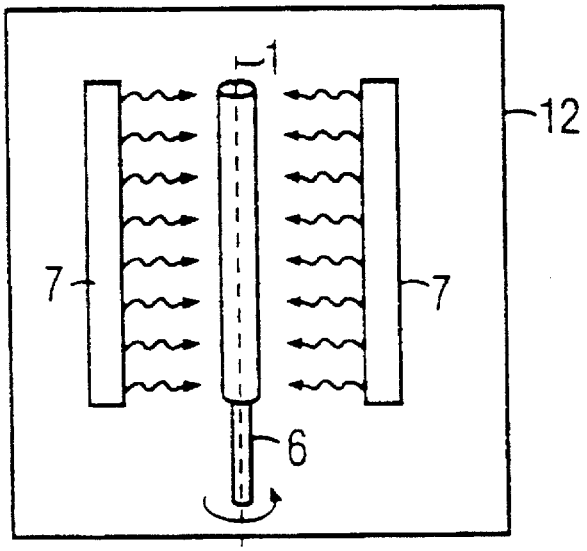
FIG. 4 shows an apparatus for removing condensation from the electron gun before carrying out the present invention.

The cleaning of a CRT electron gun 1, as shown in a generally cylindrical schematic form in the drawing figures, according to the present invention, is carried out by first heating the electron gun prior to cleaning in order to prevent condensation from forming on the CRT gun surfaces. This occurs by mounting the electron gun 1 onto a spindle 6 and inserting the arrangement into a heating structure. For example, FIG. 4 shows the heating of the electron gun in a halogen infrared heating station 12. The electron gun 1 is placed between the infrared heaters 7 and rotated on the spindle 6 at temperatures greater than about 65° C. but less than 125° C. This is carried out to heat the electron gun and prevent any condensation from forming at the cleaning station.

Figure 2:
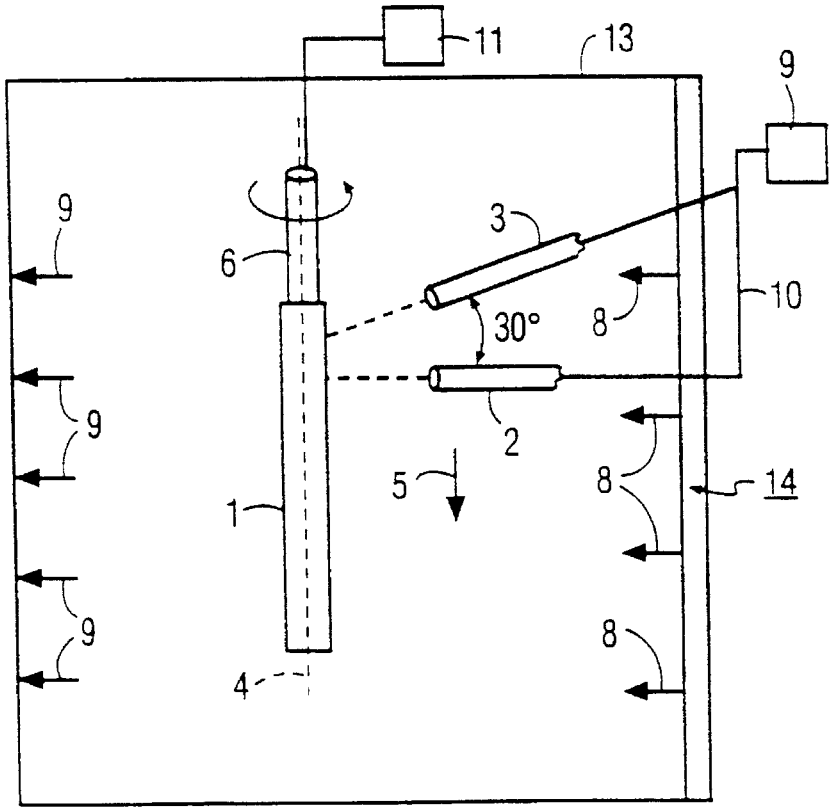
FIG. 2 shows a schematic cross-sectional arrangement parallel to the axis of the cleaned CRT gun of the present invention.

Such cleaning is carried out in a cleaning station 13 as shown in FIG. 2. In this cleaning station, the CRT electron gun 1, shown in schematic cylindrical form, which is mounted on the spindle 6, is rotated by way of a rotating apparatus 11, shown in block form. The CRT gun is rotated about the axis 4 by the rotating apparatus to a rotational speed of about 300 RPM maximum. Greater speeds than 300 RPM may result in mechanical damage to the electron gun 1, while slower speeds will require a longer cleaning cycle time.

Within the cleaning station 13 are mounted two cleaning nozzles 2 and 3 which pass $CO_2$ gas and solid dry ice particles or snow of $CO_2$. This occurs by specially designed orifices for the nozzles which control the size of the dry ice particles or snow. Such nozzle orifices may have size having an inside diameter of 0.016 to 0.020 inches, for example.

Figure 1:
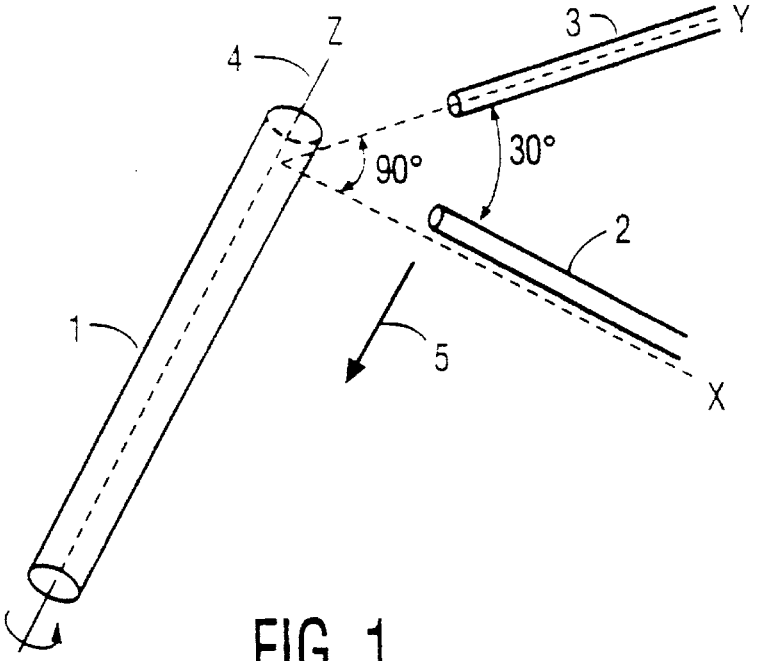
FIG. 1 shows a schematic perspective view of the cleaning structure according to the present invention.
Figure 3:
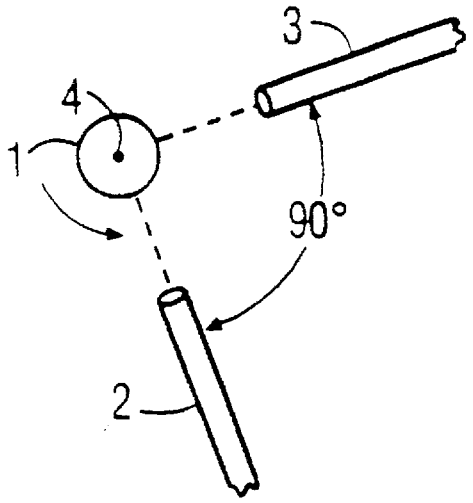
FIG. 3 shows a cross-section perpendicular to the axis according to the present invention.

The nozzles 2 and 3 are mounted angularly with respect to one another and with respect to the electron gun 1. In this respect, the electron guns 2 and 3 are mounted at an angle of 30° along the axis 4 relative to one another, while the electron guns are mounted at an angle of 90° relative to a plane intersecting the axis 4 of electron gun 1. Typically this plane is perpendicular to the axis 4. This angular position of the nozzles 2 and 3 may be seen by reference to each of FIGS. 1, 2 and 3 in which FIG. 1 shows the angles in a schematic perspective view of the electron gun and its axis relative to the two nozzles 2 and 3.

These nozzles 2 and 3 are then moved along the electron gun 1 in the direction 5 such as seen in FIG. 2. This allows the jet spray of $CO_2$ snow particles and $CO_2$ gas to strike all of the surfaces of the electron gun 1. A typical cleaning time is about 2–3 seconds during which time the cleaning nozzles 2 and 3 move from one end of the electron gun 1 to the other end.

The cryo jet spray of dry ice ($CO_2$) particles dislodges contaminants from the CRT electron gun 1 and the removed contaminants are carried away in the gaseous stream. The gaseous stream is contained in a laminar air flow 8 from side 14 through the chamber 13 to exit through the exhaust side 9. The air flow 8 is a high velocity laminar air flow of 375 feet per minute. This laminar airflow isolates the CRT electron gun 1 from the contamination of removed particles and other contaminants. This high speed air flow will carry such potential contaminating particles away from the electron gun mount and out of the cleaning zone.

Further, an air ionization bar at the position 14 will control the build-up of static electricity on the CRT electron gun 1. Accordingly, electrostatic attraction of particles to the gun after cleaning is prevented.

The exhaust system provides a balanced negative pressure at the downstream side of the air flow from the electron gun 1. This ensures air flow laminarity with exhaust heat being carried away from the heated electron gun 1, exhaust flow of the $CO_2$ from the cleaning position and capture of the particulate matter carried by the air flow.

The mounting of the nozzles 2 and 3 is such that the nozzle tip to the surface of the electron gun 1 will be about 2 inches for each nozzle. This distance may be varied, as well as the orifice shape and size or inside diameter of the nozzles.

The speed of rotation of the CRT electron gun 1 may be varied, although as mentioned above, greater times than 300 RPM may result in mechanical damage, while slower times will require longer cleaning cycle times.

Also, other methods of heating the CRT electron gun 1 may be used other than the infrared heater 12 as shown in FIG. 4. For example, conventional heating or dry heating before $CO_2$ cleaning can be used.

The $CO_2$ may be supplied from a system 9 in FIG. 2 which may include either a bulk tank or gas cylinders with purifiers to create a high purity $CO_2$ stream. The purity may be of 99.999% which further enables precision cleaning. The $CO_2$ pressure of the bulk tank is about 350 psi which is then increased by way of a pressure boosting system to increase the pressure to about 835 psi for operation according to the present invention.

The nozzles 2 and 3 may be formed at a length of about 16 inches each. The flow of $CO_2$ gas and dry ice particles through the orifices depend on the size of the orifice openings which can be controlled to fairly small inside diameters.

What we claim:

1. A method of cleaning CRT electron guns comprising the steps of (a) heating an electron gun, and (b) passing combined $CO_2$ particles and $CO_2$ gas to said electron gun to remove contaminants from said electron gun.

2. A method according to claim 1, characterized in that removal of contaminants from said electron gun is carried out by arranging at least two nozzles to pass said combined particles and gas at a first angle to each other and at a second angle relative to said electron gun.

3. A method according to claim 1, characterized in that said electron gun is heated to at least 65 C.

4. A method according to claim 1, characterized in that said electron gun is moved with respect to means for directing combined $CO_2$ particles and $CO_2$ gas along all surfaces of said electron gun to remove said contaminants from said electron gun.

5. A method according to claim 4, characterized in that said electron gun is rotated with respect to said means for directing said combined particles and gas along all surfaces of said electron gun to remove contaminants from said electron gun.

6. A method according to claim 9, characterized in that said electron gun is rotated at a speed of at most 300 RPM.

7. An apparatus for cleaning contaminants from CRT electron guns comprising:

(a) first means for holding and moving an electron gun, (b) second means for directing combined $CO_2$ particles and $CO_2$ gas to said electron gun to remove contaminants, (c) third means for moving said second means along said electron gun, and (d) fourth means for carrying said contaminants from said electron gun.

8. An apparatus according to claim 7, wherein said second means includes at least two nozzles arranged at a first angle to each other and at a second angle with respect to said electron gun.

* * * * *